US006435375B2

(12) United States Patent
Durham et al.

(10) Patent No.: US 6,435,375 B2
(45) Date of Patent: Aug. 20, 2002

(54) MODULAR VOLUMETRIC VALVE SYSTEM

(75) Inventors: Samuel Durham, San Antonio, TX (US); Gary Vance Paisley, Alpharetta, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/802,170

(22) Filed: Mar. 8, 2001

Related U.S. Application Data

(63) Continuation of application No. 09/245,594, filed on Feb. 8, 1999, now abandoned.

(51) Int. Cl.[7] ..... B67D 5/56
(52) U.S. Cl. ..... 222/129.1; 222/57
(58) Field of Search ..... 222/129.1, 129.2, 222/129.3, 129.4, 57, 504, 249

(56) References Cited

U.S. PATENT DOCUMENTS

| | | | | |
|---|---|---|---|---|
| 1,600,170 | A | 9/1926 | Henderson | 222/129.1 |
| 3,168,967 | A | 2/1965 | Giampa | 222/129.1 |
| 3,283,957 | A | 11/1966 | Henderson | 222/57 |
| 3,289,889 | A | 12/1966 | Schwieger | 222/57 |
| 3,599,833 | A | 8/1971 | Reichenberger | 222/129.1 |
| 3,610,205 | A | 10/1971 | Rarey | 222/57 |
| 4,194,650 | A | 3/1980 | Nottke et al. | 222/57 |
| 4,801,048 | A | 1/1989 | Credle, Jr. et al. | 222/129.1 |
| 4,821,925 | A | 4/1989 | Wiley et al. | 222/129.4 |
| 4,886,190 | A | 12/1989 | Kirschner et al. | 222/57 |
| 5,314,091 | A | 5/1994 | Credle, Jr. | 222/129.1 |
| 5,381,926 | A | 1/1995 | Credle, Jr. et al. | 222/1 |
| 5,725,125 | A | 3/1998 | Bessette et al. | 222/1 |
| 5,797,519 | A | 8/1998 | Schroeder et al. | 222/129.1 |
| 5,803,320 | A | 9/1998 | Cutting et al. | 222/641 |
| 5,967,367 | A | 10/1999 | Orsborn | 222/129.1 |

FOREIGN PATENT DOCUMENTS

| | | |
|---|---|---|
| DE | 42 28775 A 1 | 3/1994 |
| EP | 0 676 366 B1 | 8/1998 |
| GB | 2 303 354 A | 2/1997 |
| WO | WO90/11961 | 10/1990 |
| WO | WO 93/25465 | 12/1993 |

*Primary Examiner*—John Kwon
(74) *Attorney, Agent, or Firm*—Sutherland Ashill & Brennan LLP

(57) ABSTRACT

A beverage dispensing system for providing a beverage from a plurality of beverage concentrate sources. The beverage dispensing system includes a nozzle, a modular diluent valve for supplying diluent to the nozzle, a plurality of modular volumetric concentrate valves each in fluid communication with one of the beverage concentrate sources, and an electronic control board. The electronic control board determines the diluent flow rate through the modular diluent valve and instructs one of the modular volumetric concentrate valves to supply a predetermined volume of a beverage concentrate to the nozzle based upon the diluent flow rate.

28 Claims, 7 Drawing Sheets

MODULAR VOLUMETRIC VALVE SYSTEM

This is a continuation of application Ser. No. 09/245,594, filed Feb. 8, 1999 now abandoned.

TECHNICAL FIELD

The present invention relates to a beverage dispensing system and more particularly relates to a plurality of modular volumetric valves for use with a post-mix beverage dispensing system.

BACKGROUND OF THE INVENTION

Beverage dispensers of various types are well known in the art. Typically, a beverage dispenser mixes a supply of a concentrate, such as syrup for soft drinks, and a supply of a diluent, such as soda water or plain water. The concentrate and the diluent are usually dispensed simultaneously through a mixing nozzle into a beverage cup. Until recently, most beverage dispensers included manually adjusted fill and/or flow controls. By maintaining consistent concentrate and diluent flow rates with varying flowing pressures, these flow controls ensure that the proper mixture ratio between the concentrate and the diluent is used. The proper mixture ratio is essential for the dispenser to serve beverages with consistent quality and taste. These manual flow controls, however, over time will inevitably "drift" out of proper adjustment, requiring revalidation and readjustment.

The introduction of "volumetric" dispensing valves largely eliminated the concern over "drift" or the maladjustment of the mixture ratios in a beverage dispenser. A volumetric dispensing valve is generally a unitary device with a diluent circuit, a concentrate circuit, and an electronic control board. The diluent circuit includes a flow meter to determine the flow rate of the diluent during a given time interval. By "flow rate", we mean the volume of the diluent. Data from the flow meter is relayed to the electronic control board. The electronic control board, in turn, processes the data, calculates the diluent flow rate, and directs the concentrate circuit to measure out a predetermined volume of the concentrate for the given volume of the diluent. By electronically measuring the diluent dispensed and injecting the correct volume of the concentrate into the diluent, a preset mixture ratio can be maintained with little need for adjustment. Such a volumetric dispensing valve is described in U.S. Pat. No. 5,381,926 entitled "Beverage Dispensing Valve and Method." The Coca-Cola Company, the assignee of the present application, owns this patent. The disclosure of U.S. Pat. No. 5,381,926 is incorporated herein by reference.

By way of example, FIG. 1 shows a schematic view of a known volumetric system 10 as used in a typical post-mix beverage dispenser 20 of FIG. 2. In this example, the beverage dispenser 20 has six (6) volumetric dispensing valves 30. Each dispensing valve 30 includes a diluent circuit 40, a concentrate circuit 50, an electronic control board 60, and a mixing nozzle 70. The electronic control board 60 on each dispensing valve 30 can be programmed to maintain a range of diluent/concentrate ratios corresponding to a wide variety of beverages or beverage flavors. In the example above, each dispensing valve 30 is connected by a diluent supply line 80 and a concentrate supply line 90 such that a total of twelve (12) incoming lines 95 are available. The beverage dispenser 20 therefore requires six (6) diluent lines 80 and six (6) concentrate lines 90 to offer up to six (6) different types of beverages or beverage flavors.

One drawback with the known volumetric valves is that their original acquisition cost is typically higher than known manually adjusted valves. Although providing a consistent mixture ratio inevitably saves maintenance costs over the working life of the valve, the requirements of having multiple diluent circuits, multiple concentrate circuits, and particularly multiple electronic control boards results in a higher initial acquisition cost. This higher acquisition cost may complicate the desires of a beverage dispenser owner or operator to have one or more beverage dispensers with as many different types of beverages or beverage flavors as possible. Further, beverage dispenser owners and operators not only desire beverage dispensers that provide as many different types of beverages and beverage flavors as possible, the dispensers also must be compact and take up as little counter space as possible.

In other words, customers desire the conflicting goals of more beverage choices, in as little counter space as possible, for as low a cost as possible. There is a need, therefore, for a beverage dispensing system that provides for these diverse goals.

SUMMARY OF THE INVENTION

The present invention provides a beverage dispensing system for dispensing a variety of beverages from a plurality of beverage concentrate sources. The beverage dispensing system includes a nozzle, a modular diluent valve for supplying diluent to the nozzle, a plurality of modular volumetric concentrate valves each in fluid communication with one of the beverage concentrate sources, and an electronic control board. The electronic control board determines the diluent flow rate through the modular diluent valve and instructs one of the modular volumetric concentrate valves to supply a predetermined volume of beverage concentrate to the nozzle based upon the diluent flow rate.

Specific embodiments of the present invention include using a flow meter with a sensor in the modular diluent valve to determine the diluent flow rate therethrough. The flow meter is operably connected to the electronic control board. The modular diluent valve also may include a solenoid to control the flow of diluent therethrough. The operation of the solenoid is controlled by the electronic control board. The modular diluent valve may supply carbonated water or noncarbonated water to the nozzle.

The plurality of modular volumetric concentrate valves each includes a metering device. The metering device has a piston positioned within a chamber with a first end and a second end. The modular volumetric concentrate valves also include a first and a second solenoid valve. The first solenoid valve is in fluid communication with the first end of the chamber while the second solenoid valve is in fluid communication with the second end of the chamber. Operation of the solenoid valves is controlled by the electronic control board so as to regulate the flow of concentrate into and out of the metering device. The electronic control board also may monitor the total volume of concentrate dispensed by the modular volumetric concentrate valves and maintain other types of use and inventory information for the system as a whole.

In another embodiment of the present invention, one of the beverage concentrate sources may be a beverage flavoring source and a second one of the plurality of modular volumetric concentrate valves may be in fluid communication with this beverage flavoring source. The electronic control board may instruct the second one of the modular volumetric concentrate valves to supply a predetermined volume of beverage flavoring to the nozzle. The concentrate and the diluent are then dispensed as described above.

A further embodiment of present invention may be a beverage dispensing system that provides a beverage with an intermediate level of carbonation. Such a system includes an electronic control board, a nozzle, a first modular diluent valve for supplying carbonated water to the nozzle, and a second modular diluent valve for supplying noncarbonated water to the nozzle. Operation of the modular diluent valves is controlled by the electronic control board such that the diluent valves are pulsed on and off. The system further includes one or more modular volumetric concentrate valves for supplying concentrate to the nozzle. The volumetric concentrate valves are in fluid communication with one of the plurality of beverage concentrate sources. The electronic control board determines the diluent flow rate through both of the diluent valves and instructs one of the volumetric concentrate valves to supply a predetermined volume of beverage concentrate to the nozzle based upon the diluent flow rate.

A further embodiment of the present invention provides a dispenser for supplying a beverage selection from a plurality of beverage options. The dispenser includes an electronic control board, a plurality of nozzles, and a plurality of modular diluent valves for supplying diluent to the nozzles. Operation of the modular diluent valves is controlled by the electronic control board so as to activate one of the modular diluent valves in response to the beverage selection. The dispenser further includes a plurality of modular volumetric concentrate valves for supplying beverage concentrate to the nozzles. Operation of the modular volumetric concentrate valves is controlled by the electronic control board such that the modular volumetric concentrate valve that corresponds to the beverage selection is activated. The electronic control board determines the diluent flow rate through the activated modular diluent valve and instructs the activated volumetric concentrate valve to supply a predetermined volume of beverage concentrate to one of the nozzles based upon the diluent flow rate so as to provide the beverage selection.

The method of the present invention provides a beverage selection from a beverage dispenser having a plurality of beverage concentrate sources, one or more nozzles, one or more modular diluent valves, and a plurality of modular concentrate valves. The method includes the steps of activating one of the modular diluent valves in response to the beverage selection so as to provide a supply of diluent to one of the nozzles, determining the diluent flow rate through the activated modular diluent valve, activating the modular volumetric concentrate valves that corresponds to the beverage selection, and instructing the activated volumetric concentrate valve to supply a predetermined volume of beverage concentrate to the nozzle based upon the diluent flow rate.

It is an object of the present invention to provide an improved beverage dispensing system.

It is another object of the present invention to provide an improved volumetric beverage dispensing valve and system.

It is yet another object of the present invention to provide a beverage dispensing system with multiple concentrate circuits using a single diluent circuit.

It is a further object of the present invention to provide a modular volumetric beverage dispensing system that is reasonably priced as compared to known beverage dispensing systems.

It is a still further object of the present invention to provide a beverage dispensing system that is as compact as possible while providing beverages and beverage flavors from multiple sources.

It is a still further object of the present invention to provide a beverage dispensing system with replaceable and interchangeable concentrate and diluent circuits.

Other objects, features, and advantages of the present invention will become apparent upon review of the following detailed description of the preferred embodiments of the invention, when taken in conjunction with the drawings and the appended claims.

DETAILED DESCRIPTION OF THE INVENTION

Figure 3:
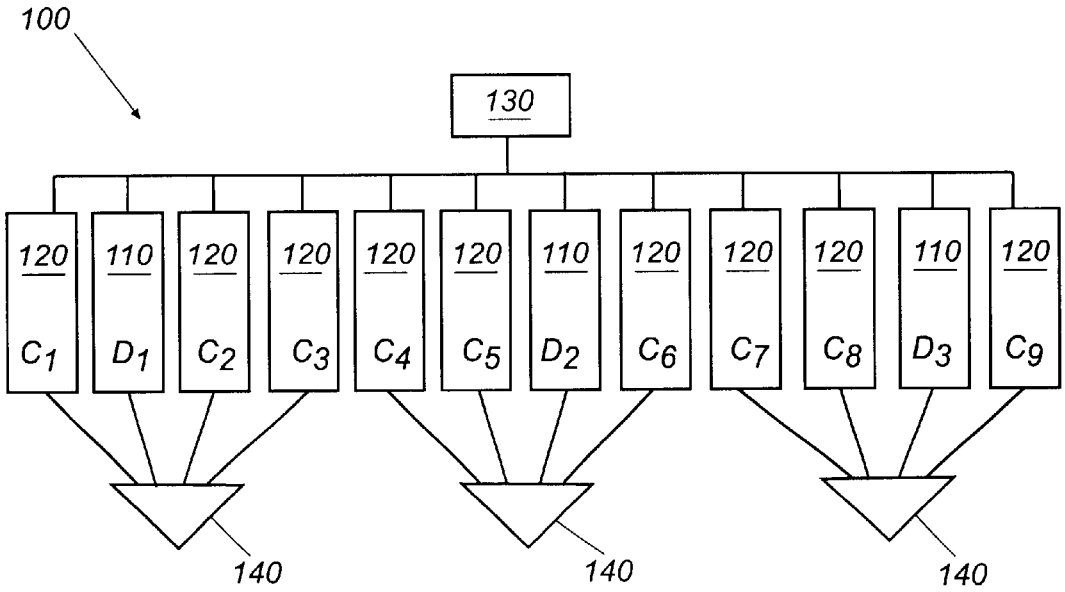
FIG. 3 is a schematic view of a modular volumetric dispensing system.

Referring now in more detail to the drawings, in which like numerals refer to like parts throughout the several views, FIG. 3 shows a modular volumetric dispensing system 100 of the present invention. Instead of the dispensing valves 30 with internal diluent circuits 40 and concentrate circuits 50, the dispensing system 100 of the present invention uses one (1) or more modular diluent valves 110 with one (1) or more modular concentrate valves 120. By the term "modular", we mean that the diluent valves 110 and the concentrate valves 120 are freestanding and interchangeable. The modular diluent valves 110 and the modular concentrate valves 120 can be employed in almost any order or number.

By way of example, FIG. 3 shows a dispensing system 100 with three (3) modular diluent valves 110, nine (9) modular concentrate valves 120, one (1) electronic control board 130, and three (3) nozzles 140. The modular design of the present invention therefore allows the dispensing system 100 to provide three (3) more beverages or beverage flavors than the six (6) beverages or beverage flavors offered in the prior art system 10, while using the same number of incoming lines 95. Further, the dispensing system 100 offers these three (3) additional beverages or beverage flavors with three (3) fewer diluent circuits, five (5) fewer electronic control boards, and three (3) fewer nozzles. It is important to note that this embodiment is exemplary only in that numerous other configurations are possible.

The only requirement of the dispensing system 100 as a whole is that the system 100 must have one at least (1) diluent valve 110, at least one concentrate valve 120, at least one (1) electronic control board 130, and at least one (1)

nozzle 140. The dispensing system 100 may be used with any conventional beverage dispenser such as the dispenser 20 described in FIG. 2. The nozzle 140 used herein may be a conventional multiflavor design or other known designs. An example of a multiflavor nozzle is found in U.S. Pat. No. 5,725,125, the disclosure of which is incorporated herein by reference.

Figure 4:
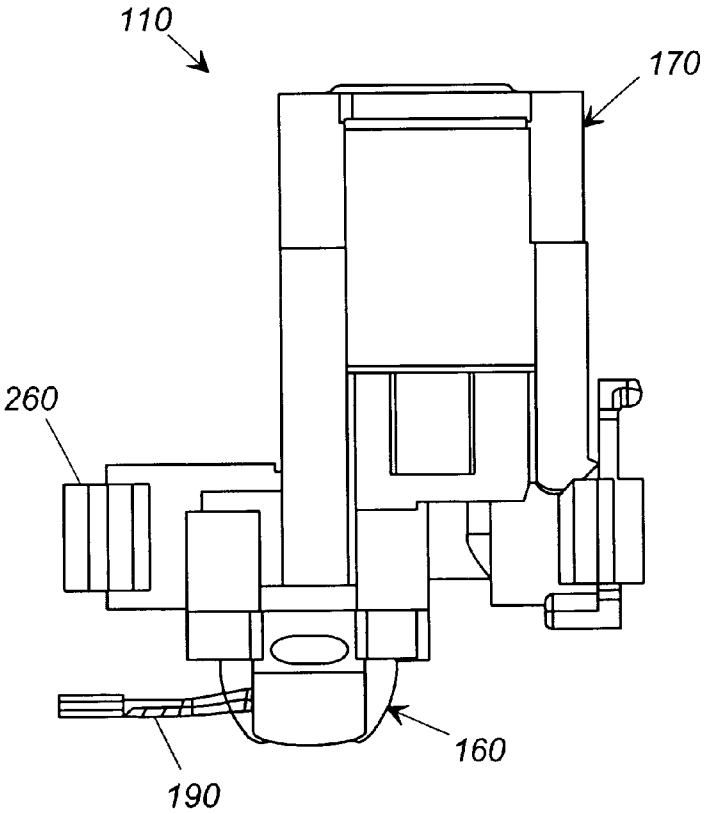
FIG. 4 is a plan view of a modular diluent water valve.
Figure 5:
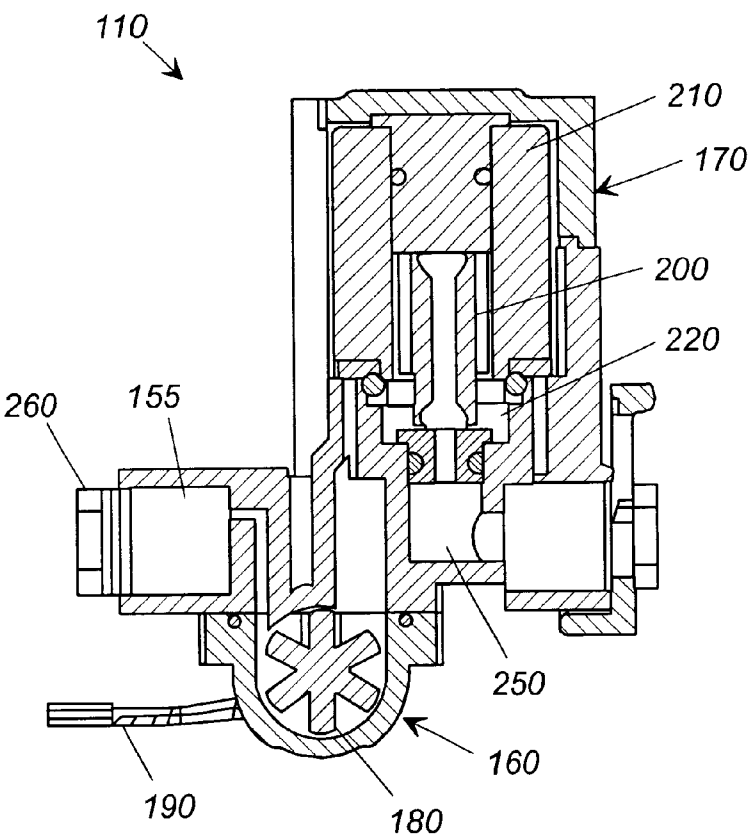
FIG. 5 is a side cross-sectional view of the modular diluent valve of FIG. 4.

FIGS. 4 and 5 show a modular diluent valve 110 for use in the present invention. It should be understood that any other suitable type of valve may be used. The diluent valve 110 includes a diluent conduit 155 through which the diluent flows through the valve 110. The valve 110 further includes a flow meter 160 and an actuator such as a solenoid valve 170. The flow meter 160 includes a rotary paddle wheel 180 and a sensor 190 positioned adjacent thereto. The rotary paddle wheel 180 is preferably a molded, one piece element with about six (6) paddles attached to a central hub. The sensor 190 may be a photosensor or other conventional type of monitoring device. The flow meter 160 determines the flow rate and therefore the volume of diluent flowing through the conduit 155 over a given time interval. For example, the flow meter 160 may track the number of times the paddles of the paddle wheel 180 break the light beam of the photosensor 190. The solenoid 170 includes a plunger 200 surrounded by an electromagnetic coil 210 for reciprocating movement therewith. The plunger 200 operatively engages a port 220. The port 220 is in fluid communication with an exit chamber 250. The diluent valve 110 also may include a manually actuable valve 260 to control the flow of diluent therethrough.

In use, when the solenoid valve 170 is energized, diluent flows through the valve 260 and into the diluent conduit 155. The diluent then flows through the flow meter 160 where its flow rate is determined by the sensor 190. The diluent is then forced by the solenoid valve 170 out of the valve 110 via the exit chamber 250. The diluent then travels to the nozzle 140 via a flexible tubing 270. The flexible tubing 270 may be of conventional design.

Figure 6:
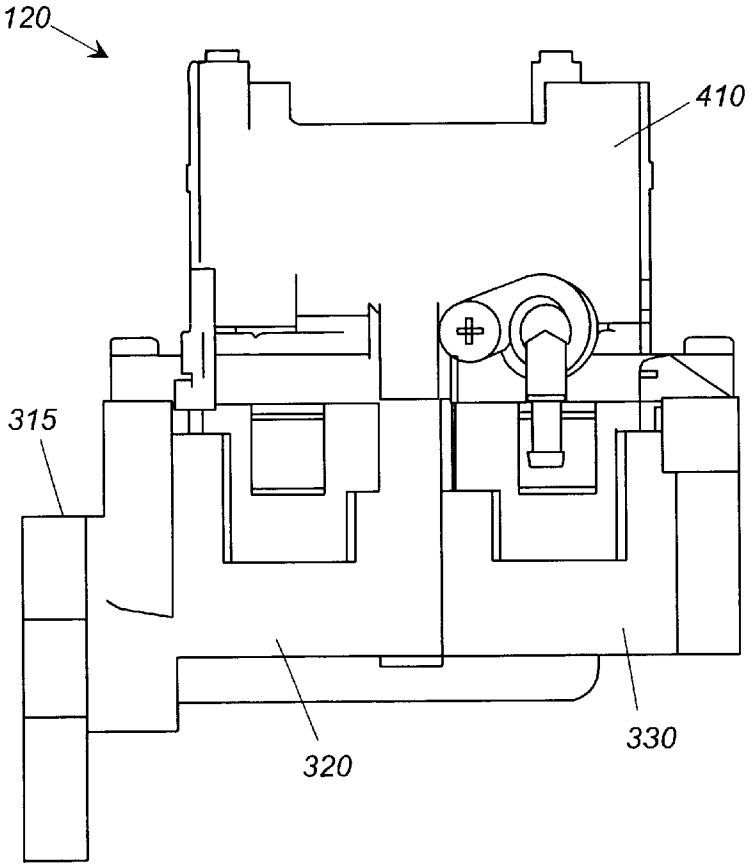
FIG. 6 is a plan view of a modular concentrate valve.
Figure 7:
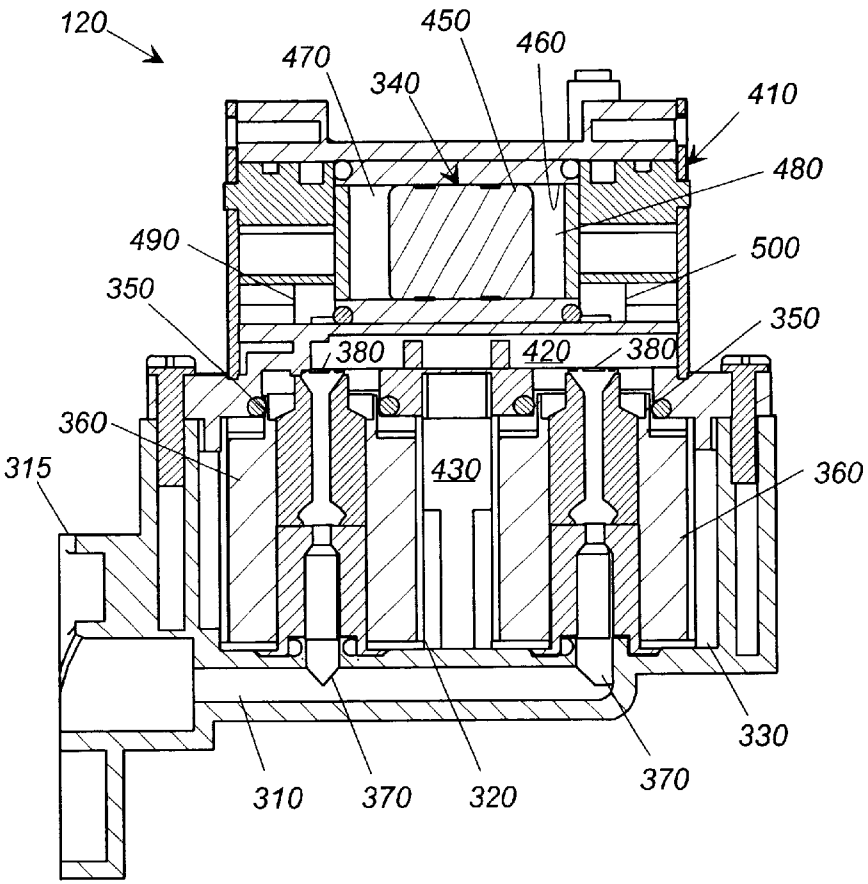
FIG. 7 is a side cross-sectional view of the modular concentrate valve of FIG. 6.

FIGS. 6 and 7 show a modular concentrate valve 120 for use in the present invention. It should be understood that any other suitable type of valve may be used. The concentrate valve 120 includes a concentrate conduit 310 through which the concentrate flows therethrough. A manually actuable valve 315 is provided in the conduit 310 to open and close the conduit 310 as needed. The concentrate valve 120 further includes a pair of solenoid valves, a first solenoid valve 320 and a second solenoid valve 330. The solenoid valves 320, 330 are identical. Both solenoid valves 320, 330 are in fluid communication with a metering device 340. The metering device 340 may be a pump or similar type of device. Both solenoid valves 320, 330 include a plunger 350 with a plurality of flow channels formed therein. The plungers 350 are surrounded by an electromagnetic coil 360 for reciprocating movement therewith. Each solenoid 320, 330 further includes a first valve 370 on the first or bottom end of the plunger 350 and a second valve 380 on the second or top end. The valves 370, 380 may be poppet valves or similar types of devices. The first valve 370 is in fluid communication with the concentrate conduit 310. Each solenoid 320, 330 is also in communication with a manifold head 410 surrounding the metering device 340. Within the manifold head 410 is a horizontally extending conduit 420 in communication with a vertical exit conduit 430. The second valve 380 of the plunger 350 is in fluid communication with the horizontally extending conduit 420.

The metering device 340 has a reciprocating piston 450 positioned within a cylindrical chamber 460. The piston 450 may be made of a ceramic material with a very close clearance between the chamber 460 and the piston 450. Alternatively, an O-ring or similar device may be provided for a fluid tight seal. The piston 450 divides the chamber 460 into two (2) separate ends, a first end 470 and a second end 480. The first end 470 of the chamber 460 is in fluid communication with the first solenoid valve 320 via a first annular chamber 490 while the second end 480 of the chamber 460 is in fluid communication with the second solenoid valve 330 via a second annular chamber 500.

In operation, the solenoid valves 320, 330 are always in opposite states. In other words, when the second solenoid valve 330 is in its first position, the first solenoid valve 320 is in its second position and vice versa. By way of example, when the second solenoid valve 330 is in the de-energized state, a flow path exists between the conduit 310 and the second solenoid valve 330 through the first valve 370. The fluid path continues through the second solenoid valve 330 and into the second end 480 of the chamber 460 of the metering device 340 via the second annular chamber 500. In a second position, when the second solenoid valve 330 is energized and the plunger 350 moves downward, the first valve 370 is sealed off such that a passageway is opened up between the second end 480 of the chamber 460 via the second valve 380 into the horizontally extending conduit 420 and the vertical exit conduit 430. The exit conduit 430 is in fluid communication with the nozzle 70 via the flexible tubing 270.

Figure 8:
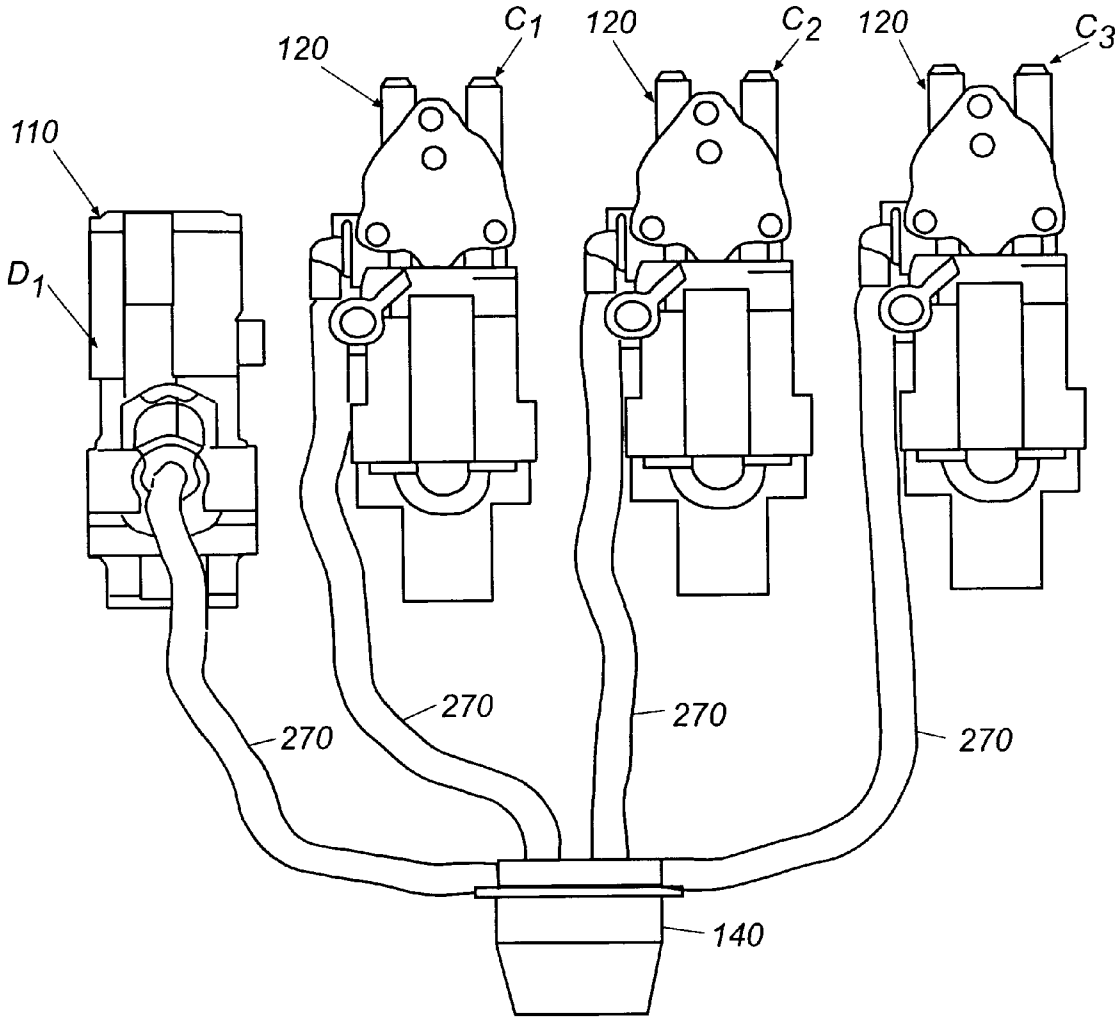
FIG. 8 is a diagrammatic view of the modular volumetric dispensing system.
Figure 9:
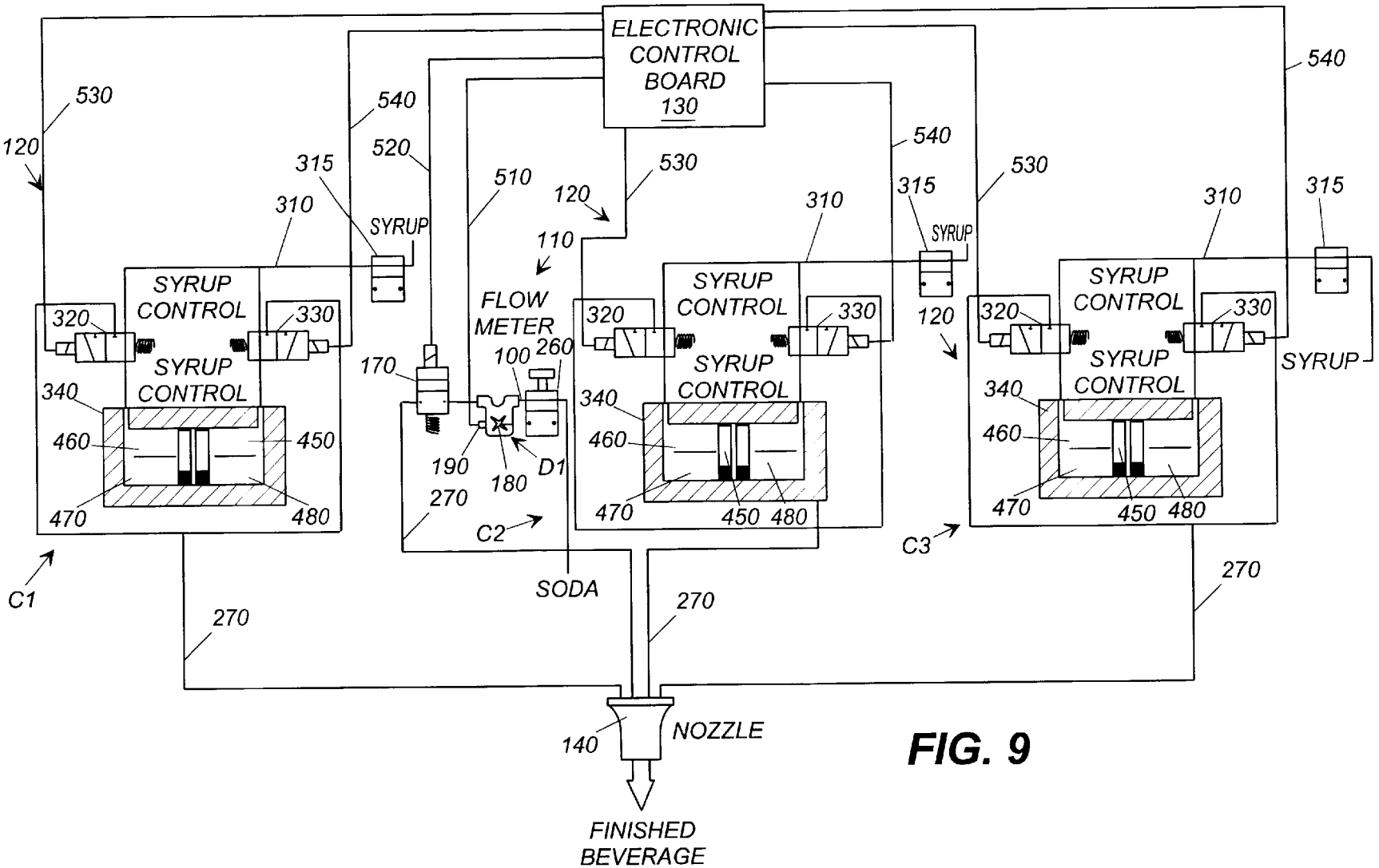
FIG. 9 is a schematic view of the modular volumetric dispensing system.

FIGS. 8 and 9 show the use of one (1) modular diluent valve 110 in combination with three (3) modular concentrate valves 120 in the modular volumetric dispensing system 100 of the present invention. Diluent valve $D_1$ and concentrate valves $C_1$, $C_2$, and $C_3$ are shown. Operation of the dispensing system 100 is controlled by the electronic control board 130. The electronic control board 130 includes a conventional microprocessor with a standard RS232 data port, although any conventional type of control board with a communications port may be used. The electronic control board 130 may include an adjustable counter AC and a flip-flop FF to determine the flow rate of the diluent in the diluent valve 110 and direct the operation of the concentrate valves 120. The electronic control board 130 is connected to the flow meter 160 via a first diluent line 510 and to the diluent solenoid 170 by a second diluent line 520. The electronic control board 130 is also connected to the solenoids 320, 330 of the concentrate valves $C_1$, $C_2$, and $C_3$ via a first solenoid line 530 and a second solenoid line 540.

In response to a request for a beverage, the electronic control board 130 determines which beverage or beverage flavor has been selected and determines the appropriate concentrate valve 120. The electronic control board 130 then activates the diluent solenoid 170 of the diluent valve 110 via the line 520. Diluent will begin to flow through the diluent conduit 155 and into the flow meter 160 so as to cause the paddle wheel 180 to rotate. Rotation of the paddle wheel 180 is then measured by the sensor 190. Pulse signals spaced according to the diluent flow rate are then sent by the sensor 190 to the electronic control board 130 via the line 510.

By way of example, the electronic control board 130 may count the pulses generated by the paddle wheel 180 by the counter AC. The counter AC generates a trigger signal when a predetermined count is reached. This predetermined count corresponds to a predetermined volume of diluent flowing over a given time interval. The counter AC may be adjusted to any desired value. The counter AC generates the trigger signal to the flip-flop FF once the counter reaches the predetermined count. The flip-flop FF changes its state to energize one or the other of the solenoid valves 320, 330 of the appropriate concentrate valve 120.

In this example described above, the electronic control board 130 applies power through the line 530 to the first solenoid 320. Power is not applied through the line 540 to the second solenoid 330. The second solenoid 330 is therefore in its de-energized first position to permit concentrate to flow through the second solenoid 330 and into the chamber 460 via the second annular chamber 500 as described above. At this point in time, the piston 450 would be disposed in the second end 480 of the chamber 460. The supply of concentrate would drive the piston 450 under pressure towards the first end 470 of the chamber 460 and force any concentrate in the first end 470 out of the first annular chamber 490 via the second valve 380 of the energized first solenoid 320. The concentrate then proceeds through the horizontal conduit 420 and into the exit conduit 430. Finally, the concentrate flows through flexible tubing 270 into the nozzle 140 where it is mixed with the diluent flowing from the diluent valve 110.

This cycle is repeated when each threshold count is reached by the counter AC. On the next cycle, the first solenoid 320 will be de-energized and switched to its first position while the second solenoid 330 is energized and switched to its second position. Concentrate will then flow into the chamber 460 via the first annular chamber 490 and force the piston 450 towards the second end 480 of the chamber 460. A volumetrically measured portion of the concentrate is therefore mixed with the diluent passing into the nozzle 140 in a controlled ratio.

Every time the predetermined count is reached by the counter AC, a trigger signal will cause the flip-flop FF to change states, thereby reversing the switching conditions and the positions of the solenoid valves 320, 330. After the correct volume of concentrate and diluent are dispensed, the electronic control board 130 turns off the diluent solenoid valve 170 and the concentrate solenoid valves 320, 330. The process is then repeated the next time a beverage is requested. The electronic control board 130 again selects the appropriate concentrate valve 120 depending upon the type of beverage selected. Although a counter AC is described herein, those skilled in the art will appreciate that the operation of the solenoids 320, 330 may be controlled in many different ways.

By using the modular diluent valves 110 and the modular concentrate valves 120, the dispensing system 100 as a whole has much more flexibility than known systems in providing beverages or beverage flavors from multiple sources. Further, the dispensing system 100 can provide different types of beverages with varying degrees of carbonation. For example, the dispensing system 100 of FIG. 3 may use carbonated water in diluent valves $D_1$ and $D_2$ and non-carbonated water in diluent valve $D_3$. This permits the dispensing system 100 to provide up to six (6) carbonated beverages, such as soft drinks, and up to three (3) non-carbonated beverages, such as tea, sport drinks, or the like.

Figure 1:
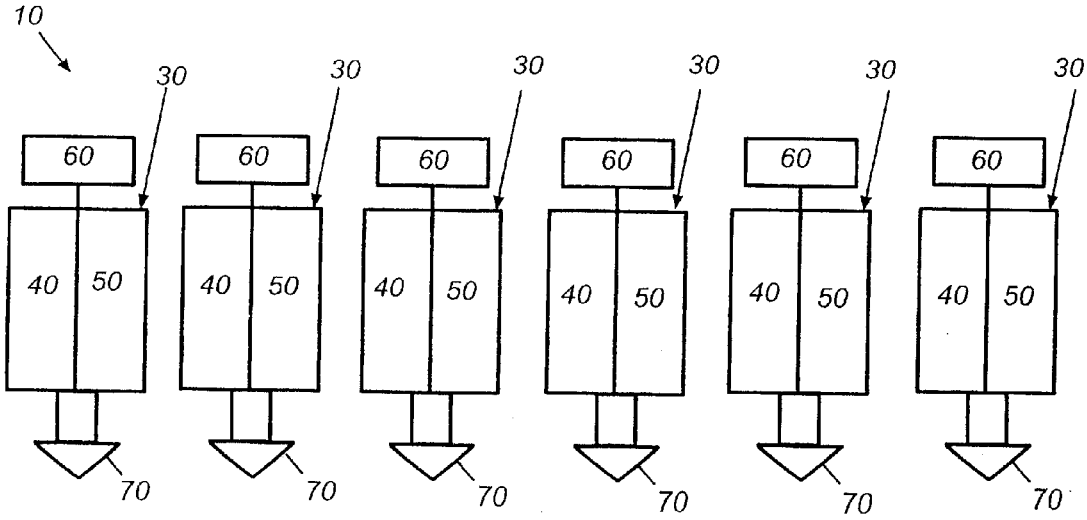
FIG. 1 (PRIOR ART)
FIG. 1 is a schematic view of a prior art volumetric dispensing system.
Figure 2:
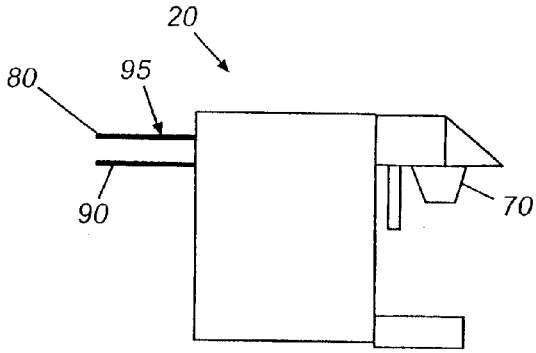
FIG. 2 is a plan view of a beverage dispenser.

The dispensing system 100 of the present invention can be used with any conventional beverage dispenser, such as the beverage dispenser 20 shown in FIG. 2. As described above, conventional beverage dispensers 20 generally have two (2) incoming lines 95, a diluent line 80 and a concentrate line 90, for each dispensing valve 30. Such conventional dispensers 20 generally also include various types of internal plumbing and refrigeration components (not shown). The dispensing valves 30 are generally installed on a manifold block (not shown) that is downstream of the plumbing and refrigeration components. The manifold block has two (2) outlets for each valve 30 that correspond to the incoming diluent line 80 and the concentrate line 90.

The retrofitting of such a conventional dispenser 20 for use with the present invention would involve removing each dispensing valve 30 and installing the modular diluent valves 110 and the modular concentrate valves 120 in the desired number and order. The manifold block may need to be lengthened to accommodate the size of the modular valves 110, 120. The appropriate diluent lines 80 and concentrate lines 90 are then connected to the dispenser 20 in corresponding order. The electronic control board 130 would then be installed and programmed for the appropriate beverages or beverage flavors. Likewise, the nozzles 140 would be attached and connected to the respective valves 110, 120 via the flexible tubing 270.

Figure 10:
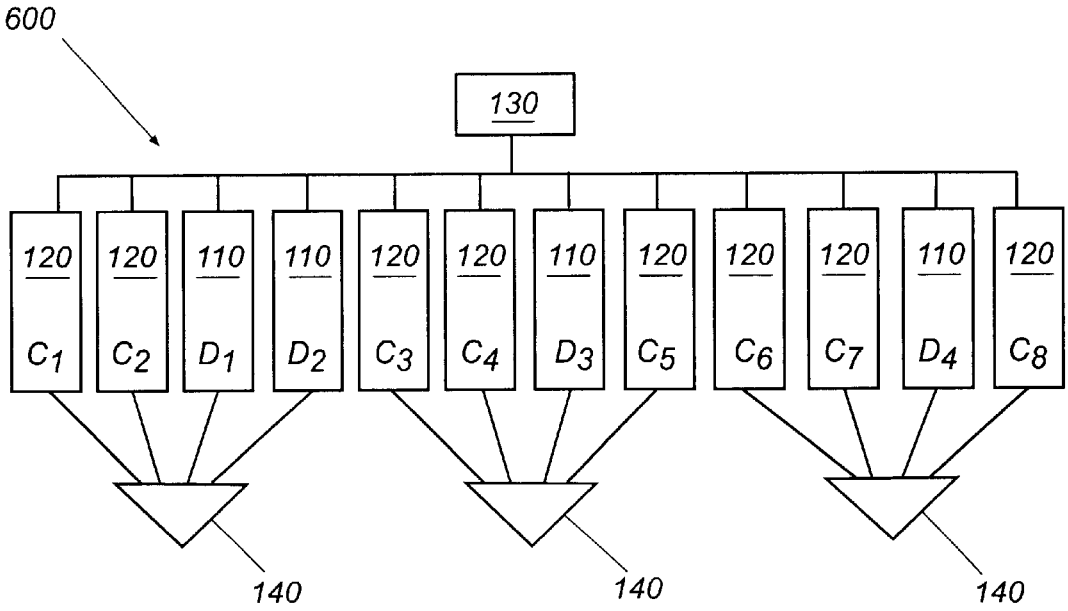
FIG. 10 is a schematic view of the modular volumetric dispensing system in an intermediate carbonated dispensing system.

FIG. 10 shows the use of a dispensing system 600 that can provide intermediate carbonated beverages. As the name implies, an intermediate carbonated beverage has a carbonation level between that of a typical carbonated beverage such as a soft drink and plain water. The intermediate level of carbonation is provided by combining soda water from a carbonated diluent valve 110 and plain water from a non-carbonated diluent valve 110. In this example, the carbonated diluent valve $D_1$ and the non-carbonated diluent valve $D_2$ would be connected to one (1) nozzle 140 by the flexible tubing 270. Likewise, a single concentrate valve $C_1$ would be connected to the same nozzle 140 by more of the flexible tubing 270. The electronic control board 130 would pulse the diluent valves $D_1$ and $D_2$ in the necessary proportions to produce a diluent stream with the proper volume of carbonation. The volume of concentrate to be added to the diluent stream by the concentrate valve $C_1$ is determined in the same manner by the electronic control board 130 as described above. The system 600 as a whole would therefore use four (4) diluent valves 110 and eight (8) concentrate valves 120.

Figure 11:
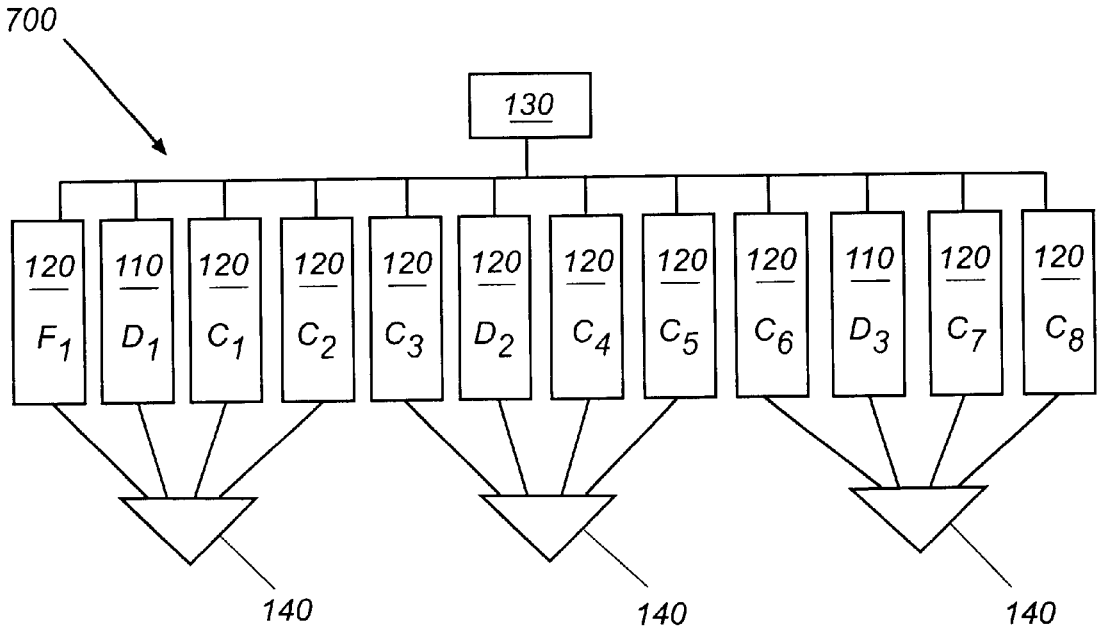
FIG. 11 is a schematic view of the modular volumetric dispensing system in a flavored beverage dispensing system.

FIG. 11 shows a dispensing system 700 that can accommodate the use of flavored beverages. One of the concentrate valves 120 may be used to provide flavoring rather than beverage concentrate. For example, the concentrate valve $F_1$ may add a cherry flavor to a soft drink. In this example, one (1) nozzle 140 would be connected by the flexible tubing 270 to at least the concentrate valve $F_1$ for the flavoring, to the concentrate valve $C_1$ for the soft drink concentrate, and to one diluent valve $D_1$. As with the volume of concentrate supplied above, the electronic control board 130 also will monitor and meter out the correct volume of flavoring, concentrate, and diluent to the nozzle 140 in predetermined ratios. The system 700 as a whole would therefore use three (3) diluent valves 110 and eight (8) concentrate valves 120.

Another advantage of the present beverage dispensing system 100 is the use of one (1) electronic control board 130 for the entire dispenser 20. The electronic control board 130 is programmable so as to accommodate changes in the beverages or the tubing of the dispensing system 100. The single electronic control board 130 also can provide detailed information on use and inventory control. For example, the electronic control board 130 can monitor accurately the concentrate use for each beverage or beverage flavor. The electronic control board 130 can then inform the user when, for example, a concentrate source needs to be replaced. The electronic control board 130 also can determine which beverages or beverage flavors are most popular, what time of the day a particular beverage or beverage flavor are generally ordered, what size beverage cups may be more popular, and any number or type of other consumption, use, or inventory information. This data can be downloaded for analysis, such as to optimize inventory control, to optimize sales, to determine user preferences, as well as many other purposes.

The dispensing system 100 of the present invention thus not only provides increased flexibility in offering more beverages and beverage flavors than known designs, but the dispensing system 100 also provides these benefits with significantly lower costs. A single dispensing system 100 can operate under the control of a single electronic control board 130 as opposed to the existing designs using a single electronic control board for each dispensing valve. Further, the number of diluent circuits can be reduced. Instead of a diluent valve for each concentrate valve, one modular diluent valve can be used with any number of concentrate valves. This reduction in redundant systems provides the significant cost benefits while also offer increased flexibility in offering more beverage choices in less space.

It should be understood that the foregoing relates only to the preferred embodiments of the present invention and that numerous changes may be made herein without departing from the spirit and scope of the invention as defined by the following claims.

We claim:

1. A beverage dispensing system for providing a beverage from a plurality of beverage concentrate sources, comprising:

a nozzle;

a modular diluent valve for supplying diluent to said nozzle;

a plurality of modular volumetric concentrate valves, said plurality of modular volumetric concentrate valves each in fluid communication with one of said plurality of beverage concentrate sources;

said modular diluent valve and said plurality of modular volumetric concentrate valves being interchangeable; and an electronic control board for determining the diluent flow rate through said modular diluent valve and instructing one of said plurality of modular volumetric concentrate valves to supply a predetermined volume of a beverage concentrate to said nozzle based upon the diluent flow rate.

2. The beverage dispensing system of claim 1, wherein said modular diluent valve comprises a flow meter to determine the diluent flow rate therethrough.

3. The beverage dispensing system of claim 2, wherein said flow meter comprises a sensor to determine the diluent flow rate therethrough.

4. The beverage dispenser system of claim 3, wherein said flow meter is operably connected to said electronic control board and wherein said electronic control board determines the diluent flow rate through said modular diluent valve based upon an input from said flow meter.

5. The beverage dispensing system of claim 1, wherein said modular diluent valve comprises a solenoid to control the flow of the diluent therethrough.

6. The beverage dispensing system of claim 5, wherein operation of said solenoid is controlled by said electronic control board.

7. The beverage dispensing system of claim 1, wherein each of said plurality of modular volumetric concentrate valves comprises a metering device.

8. The beverage dispensing system of claim 7, wherein said metering device comprises a piston positioned within a chamber with a first end and a second end.

9. The beverage dispensing system of claim 8, wherein each of said plurality of modular volumetric concentrate valves comprises a first and a second solenoid valve.

10. The beverage dispensing system of claim 9, wherein said first solenoid valve is in fluid communication with said first end of said chamber and said second solenoid valve is in fluid communication with said second end of said chamber.

11. The beverage dispensing system of claim 10, wherein operation of said first and said second solenoid valves is controlled by said electronic control board so as to regulate the flow of concentrate into said metering device.

12. The beverage dispensing system of claim 1, wherein said electronic control board monitors the total volume of concentrate dispensed by said plurality of modular volumetric concentrate valves.

13. The beverage dispensing system of claim 1, wherein one of said beverage concentrate sources comprises a beverage flavoring source and wherein a second one of said plurality of modular volumetric concentrate valves is in fluid communication with said beverage flavoring source.

14. The beverage dispensing system of claim 13, wherein said electronic control board instructs said second one of said plurality of modular volumetric concentrate valves to supply a predetermined volume of beverage flavoring to said nozzle.

15. The beverage dispensing system of claim 1, wherein said plurality of modular volumetric concentrate valves comprises three modular volumetric concentrate valves.

16. The beverage dispensing system of claim 1, wherein said modular diluent valve supplies carbonated water to said nozzle.

17. The beverage dispensing system of claim 1, wherein said modular diluent valve supplies noncarbonated water to said nozzle.

18. A beverage dispensing system for providing a beverage with an intermediate level of carbonation from one or more beverage concentrate sources, comprising:

an electronic control board;

a nozzle;

a first modular diluent valve for supplying a carbonated water to said nozzle;

a second modular diluent valve for supplying a noncarbonated water to said nozzle;

operation of said first and said second modular diluent valves controlled by said electronic control board such that said first and said second diluent valves are pulsed on and off by said electronic control board; and one or more modular volumetric concentrate valves for supplying a concentrate to said nozzle, said one or more volumetric concentrate valves each in fluid communication with said one or more beverage concentrate sources;

said electronic control board determining the flow rate of said carbonated water through said first modular diluent valve and the flow rate of said noncarbonated water through said second modular diluent valve and instructing one of said one or more volumetric concentrate valves to supply a predetermined volume of beverage concentrate to said nozzle based upon the flow rate of said carbonated water and said noncarbonated water.

19. A beverage dispensing system for providing a beverage selection from a plurality of beverage options, said beverage options representing a plurality of beverage concentrate sources, comprising:

an electronic control board;

a plurality of nozzles;

a plurality of modular diluent valves, each of said plurality of diluent valves supplying diluent to one of said plurality of nozzles;

operation of said plurality of modular diluent values controlled by said electronic control board such that said electronic control board activates one of said plurality of modular diluent valves in response to said beverage selection; and a plurality of modular volumetric concentrate valves, said plurality of modular volumetric concentrate valves each in fluid communication with one of said plurality of concentrate sources, and said plurality of modular volumetric concentrate valves each supplying beverage concentrate to one of said plurality of nozzles;

said plurality of modular diluent valves and said plurality of modular volumetric concentrate valves being interchangeable;

operation of said plurality of modular volumetric concentrate valves controlled by said electronic control board such that said electronic control board activates one of said plurality of modular volumetric concentrate valves that corresponds to said beverage selection;

said electronic control board determining the diluent flow rate through said one of said plurality of modular diluent valves and instructing said one of said plurality of volumetric concentrate valves to supply a predetermined volume of beverage concentrate to one of said plurality of nozzles based upon the diluent flow rate so as to provide said beverage selection.

20. A method for providing a beverage selection from a beverage dispenser comprising a plurality of beverage concentrate sources, one or more nozzles, one or more modular diluent valves, and a plurality of modular volumetric concentrate valves, said plurality of modular diluent valves and said plurality of modular volumetric concentrate valves being interchangeable, such that each of said one or more nozzles comprises fluid access to said one or more diluent valves and to said plurality of concentrate valves, said method comprising the steps of:

activating one of said one or more modular diluent valves in response to said beverage selection so as to provide a supply of diluent to one of said one or more nozzles;

determining the diluent flow rate through said one of said one or more modular diluent valves;

activating one of said plurality of modular volumetric concentrate valves that corresponds to said beverage selection; and instructing said one of said one or more modular volumetric concentrate valve to supply a predetermined volume of beverage concentrate to said one of said one or more nozzles based upon the diluent flow rate.

21. A beverage dispensing system for providing a beverage with a variable level of carbonation, comprising:

an electronic control board;

a nozzle;

a first modular valve for supplying a first fluid to said nozzle;

a second modular valve for supplying a second fluid to said nozzle;

one or more third modular valves for supplying a third fluid to said nozzle; and said electronic control board determining the flow rate of said first fluid through said first modular valve and instructing said second modular valve to supply a predetermined volume of said second fluid to said nozzle based upon the flow rate of said first fluid and instructing one of said one or more third modular valves to supply a predetermined volume of said third fluid to said nozzle based upon the flow rate of said first fluid.

22. The beverage dispensing system of claim 21, wherein said second modular valve comprises a volumetric valve.

23. The beverage dispensing system of claim 21, wherein said one or more third modular valves comprise a volumetric valve.

24. The beverage dispensing system of claim 21, wherein said third fluid comprises a concentrate.

25. The beverage dispensing system of claim 24, wherein said first fluid comprises a carbonated water.

26. The beverage dispensing system of claim 25, wherein said second fluid comprises a non-carbonated water.

27. The beverage dispensing system of claim 24, wherein said first fluid comprises a non-carbonated water.

28. The beverage dispensing system of claim 27, wherein said second fluid comprises a carbonated water.

* * * * *